United States Patent [19]

Josyula et al.

[11] Patent Number: 4,547,091

[45] Date of Patent: Oct. 15, 1985

[54] FILE FASTENERS

[76] Inventors: Bhagavan V. Josyula; George Spector, both of 233 Broadway, Rm. 3615, New York, N.Y. 10007

[21] Appl. No.: 641,788

[22] Filed: Aug. 16, 1984

[51] Int. Cl.[4] ..... B42F 3/00

[52] U.S. Cl. ..... 402/12; 402/80 R

[58] Field of Search ..... 402/7, 8, 9, 12, 13, 402/18, 80 R

[56] References Cited

U.S. PATENT DOCUMENTS 2,614,567 10/1952 Kinney ..... 402/12 X 3,116,738 1/1964 Wentges ..... 402/12

FOREIGN PATENT DOCUMENTS 277788 9/1927 United Kingdom ..... 402/12

*Primary Examiner*—Paul A. Bell

[57] ABSTRACT

A file fastener is provided and consists of a stack of paper sheets, a pair of protective covers, a pair of plates, a pliable hollow tube that passes through holes in the sheets, the covers and the plates and around notched corners in the plates. A short rod secures both ends of the tube together to form a continuous locking band thereof.

6 Claims, 6 Drawing Figures

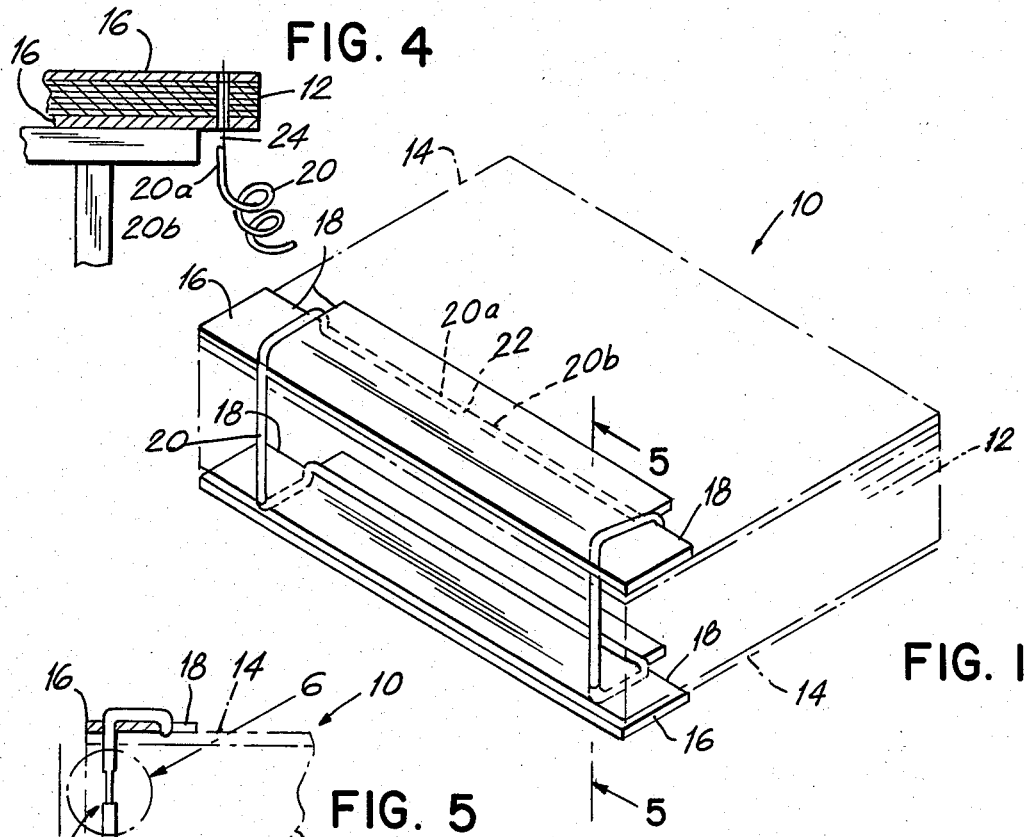
FIG. 4
FIG. 1
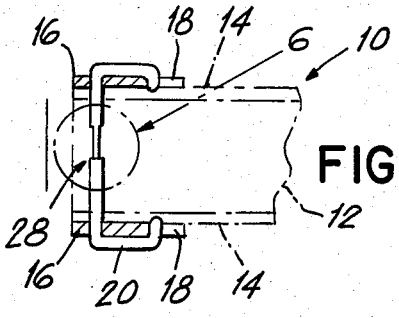
FIG. 5
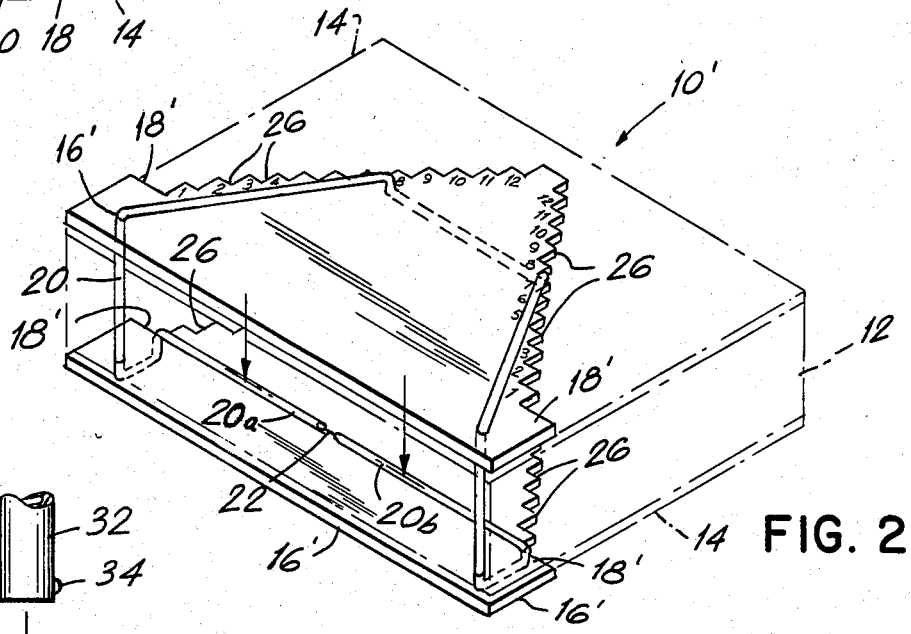
FIG. 2
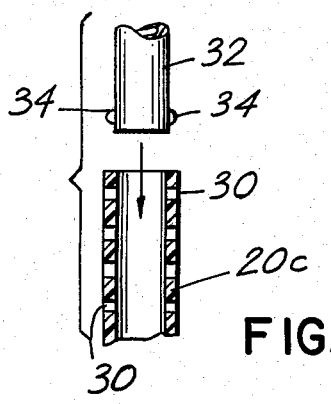
FIG. 6
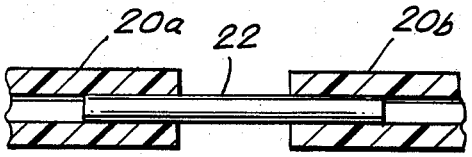
FIG. 3

FILE FASTENERS

BACKGROUND OF THE INVENTION

The instant invention relates generally to loose leaf books and binders and more specifically it relates to a file fastener.

Numerous loose leaf books and binders have been provided in prior art that are adapted to hold a plurality of sheets together. For example U.S. Pat. Nos. 251,998; 826,460 and 1,244,233 all are illustrative of such prior art. While these units may be suitable for the particular purpose to which they address, they would not be suitable for the purposes of the present invention as heretofore described.

SUMMARY OF THE INVENTION

A principle object of the present invention is to provide a file fastener that uses a pliable tube to fasten sheets together and does not damage the sheets like the currently available metallic fasteners.

Another object is to provide a file fastener so that after the sheets are filed by a simple adjustment, they can be flipped open like pages in a hard cover book and when not in use, the sheets can be held together tightly.

An additional object is to provide a file fastener that is adjustable so that the stack of sheets can be varied according to need.

A further object is to provide a file fastener that is simple and easy to use.

A still further object is to provide a file fastener that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention with protective covers and sheets in phantom.

FIG. 2 is a perspective view of a first modification of the invention being an adjustable type with protective covers and sheets in phantom.

FIG. 3 is an enlarged cross sectional view taken along line 3—3 in FIG. 2 showing how the ends of the pliable tube are secured together.

FIG. 4 is a partial end view in section showing how a pliable tube is threaded through a stack of sheets.

FIG. 5 is a partial cross sectional view of a second modification taken along line 4—4 in FIG. 1 showing the pliable tube as being adjustable within the holes of the stack of sheets.

FIG. 6 is a partial exploded enlarged view as indicated in FIG. 4 with parts in section showing how the telescopic ends of the pliable tube are adjusted to different positions.

DETAILED DESCRIPTION OF THE PREFERRED EMBODIMENTS

Turning now descriptively to the drawings, in which similar reference characters denote similar elements throughout the several views, FIG. 1 illustrates a file fastener 10 that consists of a stack of paper sheets 12, shown in phantom, each having two holes, a pair of protective covers 14, shown in phantom, each having two holes and placed on top and bottom of the sheets 12, a pair of plates 16, each having two holes and two notched corners 18. Each notched corner 18 is in alignment with one of the holes. Each plate 16 is placed on top and bottom of the covers 14. A pliable hollow tube 20 passes through the holes in the sheets 12, the covers 14 and the plates 16 and around the notched corners 18 in the plates 16.

A short rigid rod 22 as best seen in FIG. 3 is inserted within each end 20*a*, 20*b* of the tube 20 coupling the ends together after the tube is passed through the holes. The rod 20 secures both ends 20*a*, 20*b* of the tube 20 together to form a continuous locking band thereof. A long rigid rod 24 shown in FIG. 4 is inserted within one end 20*a* or 20*b* of the tube 20 to faciliate passage of the tube through the holes.

A modified file fastener 10' is shown in FIG. 2. Each plate 16' has a series of steps 26 along each notched corner 18' for adjusting the tube 20 around any two steps 26 on each plate 16' for various size stacks of paper sheets 12.

In FIG. 5 the file fastener 10 can further contain a device 28 for adjusting length of the tube 20 within the holes of the stack of paper sheets 12. The device 28 as best seen in FIG. 6 consists of one end 20*c* of the tube 20 being hollow and has a series of longitudinal spaced apertures 30 therein. The other end 20*d* of the tube 20 has a reduced diameter extension 32 with a detents 34 thereon. The extension 32 can be inserted within the hollow end 20*c* of the tube with the detents 34 engaging any of the apertures 30.

The plates 16, 16' the short rod 22 and the long rod 24 are all fabricated from hard plastic while the pliable hollow tube 20 is fabricated from soft plastic.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A file fastener which comprises:

a. a stack of paper sheets, each said sheet having two holes;

b. a pair of protective covers, each said cover having two holes and placed on top and bottom of said sheets;

c. a pair of plates, each said plate having two holes and two notched corners, each said notched corner in alignment with one of said holes with each said plate placed on top and bottom of said covers;

d. a pliable hollow tube passing through said holes in said sheets said covers and said plates and around said notched corners in said plates; and e. means for securing both ends of said tube together to form a continuous locking band thereof.

2. A file fastener as recited in claim 1, further comprising a long rigid rod to be inserted within one end of said tube to faciliate passage of said tube through said holes.

3. A file fastener as recited in claim 2, wherein said means for securing both ends of said tube together to form a continuous locking band thereof comprises a short rigid rod inserted within each said end of said tube coupling said ends together after said tube is passed through said holes.

4. A file fastener as recited. in claim 3, wherein each said plate further having a series of steps along each said notched corner for adjusting said tube around any two said steps on each said plate for various size stacks of paper sheets.

5. A file fastener as recited in claim 2, further comprising means for adjusting length of said tube within said holes of said stack of paper sheets.

6. A file fastener as recited in claim 5, wherein said means for adjusting length of said tube within said holes of said stack of paper sheets comprises:

a. one said end of said tube being hollow and having a series of longitudinal spaced apertures therein; and b. other said end of said tube having a reduced diameter extension with a detent thereon so that said extension can be inserted within said hollow end of said tube with said detent engaging any one of said apertures.

* * * * *